US005906762A

United States Patent [19]

Okabayashi

[11] Patent Number: 5,906,762

[45] Date of Patent: May 25, 1999

[54] FIXING DEVICE

[75] Inventor: Eiji Okabayashi, Toyokawa, Japan

[73] Assignee: Minolta Co., Ltd., Osaka, Japan

[21] Appl. No.: 09/075,231

[22] Filed: May 11, 1998

Related U.S. Application Data

[62] Division of application No. 08/740,283, Oct. 25, 1996.

[30] Foreign Application Priority Data

Oct. 27, 1995 [JP] Japan ..... 7-280921
Oct. 31, 1995 [JP] Japan ..... 7-283323

[51] Int. Cl.[6] ..... G03G 15/20

[52] U.S. Cl. ..... 219/216; 399/69; 399/333

[58] Field of Search ..... 219/216, 469–471; 399/69, 330–334; 432/60, 228; 118/60; 492/46

[56] References Cited

U.S. PATENT DOCUMENTS

| | | | |
|---|---|---|---|
| 3,805,020 | 4/1974 | Bates | 219/469 |
| 4,091,673 | 5/1978 | Tamura et al. | 432/60 |
| 4,745,431 | 5/1988 | Kogure et al. | 399/69 |
| 5,587,097 | 12/1996 | Sato et al. | 219/216 |

FOREIGN PATENT DOCUMENTS

| | | |
|---|---|---|
| 54-60931 | 5/1979 | Japan . |
| 55-62474 | 5/1980 | Japan . |
| 57-63570 | 4/1982 | Japan . |
| 59-171980 | 9/1984 | Japan . |
| 3-80279 | 4/1991 | Japan . |
| 4-305679 | 10/1992 | Japan . |

*Primary Examiner*—Teresa Walberg
*Assistant Examiner*—J. Pelham
*Attorney, Agent, or Firm*—McDermott, Will & Emery

[57] ABSTRACT

A fixing device for heating and fixing an unfixed image to a record member, including: a heating roller having a core roller and a layer of a resistance heating material formed on an outer or inner peripheral surface of the core roller; a pair of carriers rotatably carrying the heating roller; a pair of ring-shaped current receiver members each located between the carrier and a center of the heating roller, a pair of current supply members being in contact with the current receiver members; and insulating members made of an electrical insulation material, each being in contact with an outer end of the current receiver member and extending toward the carrier, wherein a distance L3 from the inner end of the carrier to the outer end of the current receiver member is 1 mm or more, a sum (L1+L2) of a width L1 of the insulating member and a height L2 of the insulating member from the core roller is 2.5 mm or more, and the distance L3 and the width L1 satisfy a relationship of L3≧L1.

A heat-resistant electrical insulation layer may cover the surface of the resistance heating material layer and a temperature sensing element may be provided, a portion of the element being in contact with the heat-resistant electrical insulation layer of the heating roller and covered with a heat-resistant electrical insulation layer. Each of the heat-resistant electrical insulation layers has a breakdown voltage of 3000 V or more.

6 Claims, 5 Drawing Sheets

FIXING DEVICE

This is a divisional of application Ser. No. 08/740,283, filed Oct. 25, 1996.

BACKGROUND OF THE INVENTION

1. Field of the Invention

The present invention relates to a fixing device for heating and thereby fixing an unfixed image such as a toner image to a record member bearing the unfixed image in an image forming apparatus such as a copying machine, a printer or the like.

2. Description of the Related Art

A fixing device in an image forming apparatus such as a printer or a copying machine generally includes a heating roller for heating and fixing an unfixed image to a record member. The record member bearing the unfixed image such as a toner image is moved between the heating roller and a backup member (generally, a pressure roller) opposed thereto, so that the unfixed image is heated and fixed by the pressure.

In many cases, the heating roller includes a heater such as a halogen lamp heater, and the roller is heated by heat radiated from the heater.

However, the heating roller containing the heater such as a halogen lamp heater as a heat source cannot rapidly heat a surface of the heating roller to a predetermined fixing temperature after start of power supply to the heater, so that a long preheating time (i.e., a warming-up time) is required before the fixing device reaches the predetermined temperature after power-on of the image forming apparatus. This prevents easy operation of the apparatus.

An example of a heating roller, which can reduce a temperature rising time for attaining the predetermined temperature, is proposed in Japanese Laid-Open Patent Publication No. 59-189381 (189381/1984). This roller includes a core roller and a resistance heating member arranged around the core roller for integral rotation. The resistance heating member is made of a substance, which generates heat when an electric current flows therethrough. The heating roller of this type has a good electrothermal converting efficiency, and can rapidly raise the surface temperature of the heating roller to a predetermined temperature after current supply to the resistance heating member, so that the preheating time of the fixing device can be reduced.

In this fixing device employing the above heating roller, the current is generally supplied to the resistance heating member via a current receiver member, which is electrically connected to the resistance heating member and rotates together with the resistance heating member, and a current supply member, which is in contact with the current receiver member. The heating roller is rotatably carried at opposite ends of the core roller by bearings, which are arranged at grounded heating roller mount units at the fixing device.

In the image forming apparatus such as a printer or a copying machine provided with the above fixing device, an openable cover is provided for accessing internal mechanisms when processing is required, e.g., for recovery from paper jamming or various kinds of maintenance. Alternatively, an upper mechanism above a sheet path may be adapted to be pivotable around a hinge arranged at the other half of the image forming apparatus. This type of apparatus is known as an image forming apparatus of a clamshell type.

In these image forming apparatuses provided with the openable cover or of the clamshell type, and particularly, in the image forming apparatus equipped with the fixing device which includes the heating roller having the resistance heating member, it is desired to eliminate a possibility of electric shock, which may be caused when an operator or a serviceman touches the fixing device or the like by opening the cover or the movable unit of the clamshell type of the image forming apparatus for recovery from paper jamming or maintenance. It is also necessary to prevent malfunction or damage of a control unit or the like, which may be caused by electrical leak from the fixing device to various portions of the image forming apparatus.

In view of the above, Japanese Laid-Open Patent Publication No. 4-305679 (305679/1992) has proposed a structure in which an electrical insulation layer interposed between a core roller and a resistance heating member is extended to appropriate positions outside current receiver members near opposite ends of a heating roller. Also, Japanese Laid-Open Patent Publication No. 59-171980 (171980/1984) has proposed a structure in which an electrical insulation layer is formed over an entire surface of a core roller forming a heating roller.

In the structure of the heating roller disclosed in Japanese Laid-Open Patent Publication No. 4-305679, the resistance heating member and the core roller is insulated from each other by the electrical insulation layer. Also, the surface of the resistance heating member is generally covered with a release layer, which also form an insulator. However, particular consideration is not given to insulation between the heating roller and a fixing device housing carrying the heating roller mount units, which may be directly touched by an operator, and particularly between the housing and a current transmission unit connected to the resistance heating member.

The reason of this is as follows. Since the electrical insulation layer insulates the resistance heating member and the core roller from each other, a designer or the like considers that current leak to the core roller is sufficiently prevented and therefore additional insulation is not required.

A current flows to the heating roller mount units in the fixing device and the housing provided with the mount units from the resistance heating member through the core roller, if the above electrical insulation layer is not employed. Even if the electrical insulation layer is provided, a current may flow to the heating roller mount units from the current receiver member, which is provided for current supply to the resistance heating member, via the core roller or directly from the current receiver member via a space.

Particularly, when the image forming apparatus is used in an atmosphere at a high humidity, it is impossible to eliminate completely the possibility of current leak through the above paths. Even if the resistance heating member is insulated from the core roller, current leak, which does not occur at a low humidity condition, may occur at a high humidity condition in the structure where appropriate insulation is not provided between the current receiver member and the core roller, and between the current receiver member and the heating roller mount units. Therefore, electric shock may occur when an operator touches the fixing device housing in the apparatus or a portion electrically connected thereto, and in other words, a possibility of electric shock cannot be eliminated completely.

In the structure disclosed in Japanese Laid-Open Patent Publication No. 59-171980, in which an electrical insulation layer 150 interposed between a resistance heating member 130 and a core roller 100 is arranged over an entire surface of the core roller 100 as shown in FIG. 9, the electrical insulation layer 150 insulates the resistance heating member 130 and the core roller 100 from each other. In this manner, the electrical insulation is provided. Also, the electrical insulation layer 150 arranged over the entire surface of the core roller 100 provides insulation between current receiver members 110 and the core roller 100. In this case, however, the electrical insulation layer 150 is present at up to ends of the core roller 100 attached to bearings, and the surface of the electrical insulation layer 150 may be damaged by a load at an inner surface of the bearing. If damaged, the heating roller cannot rotate stably, and the heating roller itself causes rotational vibration, so that wrinkles are formed at a record member during transfer between the rollers and irregular rotation of the current receiver member 110 occurs. This may result in such a state that a distance between the current receiver member 110 and a roller mount unit 170 at the housing 30 decreases, so that a leak current flows from the current receiver member 110 to the housing 30 through a space.

Generally, in the fixing device employing the heating roller having the resistance heating member described above, a current supply to the resistance heating member is controlled to set the heating roller temperature to a predetermined fixing temperature. Further, the heating roller temperature may be controlled to prevent excessive temperature rising of the heating roller for safety.

For the temperature control of the heating roller, such measures are well known and employed that a temperature sensing element of a contact type such as a thermistor is arranged for the heating roller so as to use sensed temperature information sent from the temperature sensing element for temperature control.

In the image forming apparatus such as a copying machine or a printer including the fixing device, which is provided with the heating roller having the resistance heating member as well as the temperature sensing element for sensing the temperature of the heating roller, and particularly in the image forming apparatus provided with the openable cover or of the clamshell type, there may be arranged a safety switch for immediately interrupting a current circuit to the resistance heating member when an operator or serviceman opens the cover or movable portion in view of the following possibility. When the cover or movable portion is opened, the operator or serviceman may receive an electric shock by touching the resistance heating member, or by touching a circuit or the like connected to the temperature sensing element, if the temperature sensing element is in contact with the resistance heating member via an insulation layer having an insufficient insulating performance.

However, the safety switch is located at a position remote from a power supply inlet portion, and, for example, at one side of the image forming apparatus opposite to the side of a commercial power supply inlet portion in many cases. Therefore, a power supply circuit line to the resistance heating member must be arranged via the safety switch at this remote position, which increases the line length, and therefore requires a large internal space for the long line. This impedes reduction in size of the apparatus and reduction in cost in many cases. Even if the safety switch is not remote from the power inlet portion, the power supply circuit line to the resistance heating member must be arranged through the safety switch, as is required in the above structure, so that a line or wiring for this purpose is required, which impedes reduction in size and cost of the apparatus.

In order to overcome the above problem, the safety switch may be eliminated, and appropriate safety means may be provided for avoiding electrical shock even when an operator touches a circuit or the like connected to the temperature sensing element. However, such appropriate safety means has been neither developed nor considered.

For example, as disclosed in Japanese Laid-Open Patent Publication No. 55-62474 (62474/1980), a resistance heating member may be coated with insulating elastomer having a thermal conductivity, and a temperature sensing element may be in contact with this covering layer. However, this elastomer layer alone cannot assure safety against current leak between the resistance heating member and the temperature sensing element. In a structure where the resistance heating member is arranged at an outer peripheral surface of the heating roller, the resistance heating member is coated with a release layer. This release layer alone cannot assure safety against current leak between the resistance heating member and the temperature sensing element.

In order to improve the safety, the insulating elastomer layer and the release layer may have large thicknesses, in which case responsibility of the temperature sensing element to the temperature of the resistance heating member is impaired, and thus the temperature of the heating roller cannot be controlled precisely.

SUMMARY OF THE INVENTION

Accordingly, an object of the invention is to provide a fixing device, which is provided with a heating roller having a resistance heating member, and is particularly to provide a safe fixing device which can reduce a possibility of electrical shock of an operator such as a user or serviceman due to the fixing device.

Another object of the invention is to provide a fixing device, which is provided with a heating roller having a resistance heating member, and is particularly to provide a safe fixing device which can reduce a possibility of malfunction or damage of a control unit and others in an image forming apparatus equipped with the fixing device due to current leak from the fixing device.

A still another object of the invention is to provide a fixing device which can ensure stable rotation of a heating roller.

A yet another object of the invention is to provide a fixing device, which is provided with a heating roller having a resistance heating member and a contact temperature sensing element for sensing a temperature of the resistance heating member for controlling a temperature of the heating roller, and particularly is to provide a safe fixing device, in which electric shock can be suppressed even when an operator touches a circuit or the like connected to the temperature sensing element.

Further another object of the invention is to provide a fixing device, which is provided with a heating roller having a resistance heating member and a contact temperature sensing element for sensing a temperature of the resistance heating member for controlling a temperature of the heating roller, and particularly is to provide a fixing device, in which the temperature sensing element as well as a circuit or the like connected thereto are protected from a leak current from the resistance heating member.

A further object of the invention is to provide a fixing device, which is provided with a heating roller having a resistance heating member and a contact temperature sensing element for sensing a temperature of the resistance heating member for controlling a temperature of the heating roller, and particularly is to provide a fixing device, in which no disadvantage arises in connection with a responsibility of the temperature sensing element to a temperature of the resistance heating member.

Yet a further object of the invention is to provide a fixing device provided with a heating roller having a resistance heating member, and in particular is to provide a fixing device, in which a conventional safety switch for interrupting a current to the resistance heating member during maintenance or the like of an image forming apparatus equipped with the fixing device is eliminated, and which can ensure safety against electric shock due to the fixing device and thereby allows a compact structure of the image forming apparatus owing to elimination of the safety switch.

The present invention provides a fixing device (i.e., fixing device of a first type) for heating and fixing an unfixed image to a record member bearing the unfixed image, including:

a heating roller having a core roller and a layer of a resistance heating material formed on an outer peripheral surface of the core roller and operable to generate heat when an electric current flows therethrough;

a pair of carriers rotatably carrying end portions of the heating roller;

a pair of ring-shaped current receiver members each located between the carrier and a center of the heating roller, being adapted to rotate together with the heating roller and electrically connected to the resistance heating material layer;

a pair of current supply members being in contact with and electrically connected to the current receiver members, respectively; and insulating members made of an electrical insulation material each being in contact with an outer end of the current receiver member and extending toward the carrier neighboring to the corresponding current receiver member, wherein a distance L3 from the inner end of the carrier to the outer end of the current receiver member neighboring to the carrier is 1 mm or more, a sum (L1+L2) of a width L1 of the insulating member and a height L2 of the insulating member from the outer surface of the core roller is 2.5 mm or more, and the distance L3 and the width L1 satisfy a relationship of $L3 \geqq L1$.

The present invention also provides a fixing device (i.e., fixing device of a second type) for heating and fixing an unfixed image to a record member bearing the unfixed image, including:

a heating roller having a cylindrical core roller and a layer of a resistance heating material formed on an inner peripheral surface of the core roller and operable to generate heat when an electric current flows therethrough;

a pair of carriers rotatably carrying end portions of the heating roller;

a pair of ring-shaped current receiver members each located between the carrier and a center of the heating roller, being adapted to rotate together with the heating roller and electrically connected to the resistance heating material layer;

a pair of current supply members being in contact with and electrically connected to the current receiver members, respectively; and insulating members made of an electrical insulation material, each being in contact with an outer end of the current receiver member and extending toward the carrier neighboring to the corresponding current receiver member, wherein a distance L3 from the inner end of the carrier to the outer end of the current receiver member neighboring to the carrier is 1 mm or more, a sum (L1+L2) of a width L1 of the insulating member and a height L2 of the insulating member from the inner surface of the core roller is 2.5 mm or more, and the distance L3 and the width L1 satisfy a relationship of $L3 \geqq L1$.

In either of the fixing devices of the first and second types, the conditions of ($L1+L2 \geqq 2.5$ mm, $L3 \geqq 1$ mm) relating to the width L1, height L2 from the outer or inner surface of the core roller and the distance L3 are set for preventing electrical leak, and were determined by an experiment which will be described later. Although a required value of the sum (L1+L2) is 2.5 mm or more, the allowable upper limit of the sum (L1+L2) is about 50 mm in view of general sizes of the fixing device, sizes of the heating roller and experience. From similar viewpoints, the allowable upper limit of distance L3 is about 50 mm.

The present invention further provides a fixing device (i.e., fixing device of a third type) for heating and fixing an unfixed image to a record member bearing the unfixed image, including:

a heating roller having a layer of a resistance heating material operable to generate heat when an electric current flows therethrough, and a heat-resistant electrical insulation layer covering the surface of the resistance heating material layer; and a temperature sensing element provided for sensing a temperature of the resistance heating material layer, and having a portion being in contact with the heat-resistant electrical insulation layer of the heating roller and covered with a heat-resistant electrical insulation layer, wherein each of the heat-resistant electrical insulation layer of the heating roller and the heat-resistant electrical insulation layer of the temperature sensing element has a breakdown voltage of 3000 V or more.

In the fixing device of the third type, the surface of the resistance heating material layer is covered with the heat-resistant electrical insulation layer, and a temperature sensing surface of the temperature sensing element is covered with the heat-resistant electrical insulation layer. Also, the temperature sensing element is in contact with the resistance heating material layer through both the insulation layers. This sufficiently reduces a possibility that an operator receives electrical shock from the resistance heating material layer, or a circuit or the like connected to the temperature sensing element. Further, the temperature sensing element is in contact with the resistance heating material layer through both the heat-resistant electrical insulation layers, and each electrical insulation layer has a breakdown voltage of 3000 V or more. Therefore, even if an insulating performance of one of the electrical insulation layers lowers or is damaged, the other insulation layer can sufficiently prevent current leak from the resistance heating material layer to the temperature sensing element, so that an operator is protected from electric shock even when the operator touches a circuit (e.g., an interface circuit, temperature control circuit) connected to the temperature sensing element. Also, the temperature sensing element itself as well as the circuit or the like connected to the temperature sensing element are protected from a leak current from the resistance heating material layer. Since safety against electric shock and current leak is ensured, the conventional safety switch is eliminated, and thus the cost and size of the image forming apparatus can be reduced.

Although the required breakdown voltage of the both electrical insulation layer is 3000 V or more, its allowable upper limit is about 20000 V in view of a generally available electrical insulation material.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Fixing Device of the First Type]

The fixing device of the first type will be described below more in detail.

The resistance heating material layer may have an outer surface covered with a coating layer made of an electrical insulation material. In this structure, and particularly in the structure in which the current receiver members and the carriers may be arranged at opposite end portions of the heating roller, the coating layer is preferably arranged over an entire area between axially inner ends of both the current receiver members. The coating layer may have release properties for preventing adhesion of melted toner.

In a structure where an end portion of the resistance heating material layer is not covered with the coating layer, the resistance heating material layer may be covered with an electrical insulation material extended from the inner end of the current receiver member toward the inner side opposite to the insulating member and extended toward the coating layer on the surface of the resistance heating material layer in order to prevent more reliably the current leak from the resistance heating material layer and/or an inner side surface of the current receiver member to the housing of the fixing device through a space. The electrical insulation material may cover fully or partially the inner side surface of the current receiver member.

The fixing device may further include a backup member operable to hold and pass the record member between the heating roller and the same for fixing the unfixed image to the record member under a pressure. The backup member may be a pressure roller pressed against the heating roller.

In the structure where the core roller of the heating roller is made of an electrically conductive material, the resistance heating material layer is preferably formed on an electrical insulation layer formed on the outer peripheral surface of the core roller. In this structure, each of the insulating members may be a portion of the electrical insulation layer.

Each of the insulating members may have a ring-shaped form formed around the outer periphery of the heating roller.

In any of the above structures, each of the insulating members may be made of at least one kind of electrical insulation material selected from resin, rubber and ceramics.

The resin may be heat-resistant resin such as polyimide (PI), polyamidimide (PAI), polytetrafluoroethylene (PTFE) or copolymer (PFA) of tetrafluoroethylene and perfluoroalkoxy ethylene.

The rubber may be heat-resistant rubber such as silicon rubber or rubber containing polytetrafluoroethylene.

The ceramics may be silicon dioxide ($SiO_2$), aluminum oxide ($Al_2O_3$), magnesium oxide (MgO), yttrium oxide ($Y_2O_3$) or zirconium oxide ($ZrO_2$).

Preferred examples of the fixing device of the first type will be described below as first, second and third embodiments.

(First Embodiment)

Figure 1:
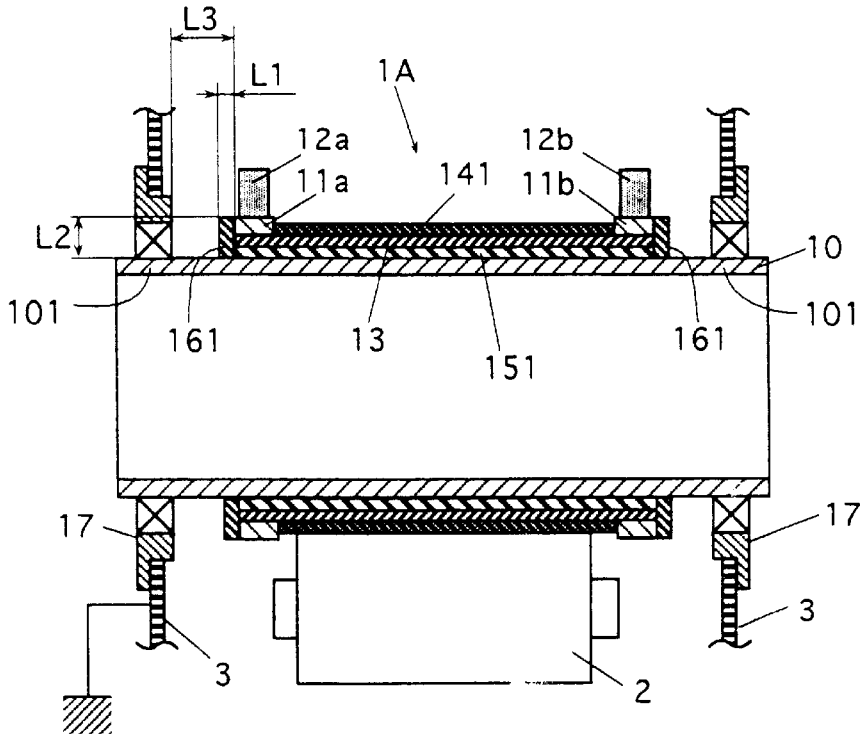
FIG. 1 is a schematic cross section of an example of a fixing device of the first type according to the invention.

FIG. 1 is a schematic cross section showing an example of the fixing device of the first type. This fixing device is operable to heat and fix an unfixed image, i.e., toner image to a record member (e.g., record paper sheet) bearing the unfixed image, and can be employed in an image forming apparatus such as a printer, copying machine or the like.

This fixing device has a heating roller 1A and a pressure roller 2 pressed against the heating roller 1A by pressing means (not shown). The heating roller 1A is rotatably carried on a housing 3 of the fixing device via heating roller mounting units 17 which include bearings fitted to opposite end portions (bearing mount ends) 101 of a core roller 10 to be described later. The housing 3 is grounded, and therefore the heating roller mount units 17 which are in contact with the housing 3 are also grounded. The pressure roller 2 is also carried rotatably by carrying means (not shown), and is driven to rotate together with the pressure roller 1A by drive means (not shown).

The heating roller 1A has the hollow and cylindrical core roller 10 made of aluminum. An electrical insulation layer 151, a resistance heating material 13 in a layer form (which will be referred to as a "resistance heating material layer") and an electrically insulating coating layer 141 are layered in this order on the outer peripheral surface of the core roller 10.

The coating layer 141 is made of polytetrafluoroethylene. The record member is held between the heating roller 1A and the pressure roller 2 opposed thereto, and is passed therebetween. For promoting release or separation of the heated toner image from the heating roller 1A, the coating layer 141 has releasing properties. The coating layer 141 is formed along the peripheral surface of the resistance heating material layer 13 and extends between the axially inner ends of the current receiver members 11*a* and 11*b*.

The resistance heating material layer 13 is formed of barium titanate ceramics, and generates heat when an electric current flows therethrough. The resistance heating material layer 13 is formed along the core roller 10 and extends between outer ends of current receiver members 11*a* and 11*b*.

The electrical insulation layer 151 is formed between the resistance heating material layer 13 and the core roller 10 for ensuring electrical insulation between them, and is made of polyimide of heat-resistant resin. The electrical insulation layer 151 has the same width as the resistance heating material layer 13 and is formed along the core roller 10. The resistance heating material layer 13, coating layer 141 and electrical insulation layer 151 rotate together with the core roller 10.

The pair of electrically conductive ring-shaped current receiver members 11*a* and 11*b* made of copper alloy are fitted and fixed around the opposite ends of the resistance heating material layer 13. The current receiver members 11*a* and 11*b* are located at such positions that the outer end of the current receiver member 11*a* (11*b*) is spaced from the inner end of the heating roller mount unit 17 neighboring thereto by a distance L3 of 2.5 mm. The current receiver members 11*a* and 11*b* also rotate together with the core roller 10.

The outer peripheral surface of the core roller 10 is covered with electrical insulation members 161, which are in contact with the outer ends of the current receiver members 11*a* and 11*b*, respectively, each extend therefrom toward the adjacent heating roller mount unit 17 and is located axially inside the bearing mount end 101 of the core roller 10. Each member 161 is provided for ensuring electrical insulation between the current receiver member 11*a* (11*b*) and the core roller 10, and thereby for preventing electrical connection between the current receiver member 11*a* (11*b*) and the heating roller mount unit 17 via the core roller 10, and is also provided for preventing electrical connection between current receiver member 11*a* (11*b*) and the heating roller mount unit 17 via a space. A length L1 of the electrical insulation member 161 along a rotation axis of the heating roller 1A (i.e., width of electrical insulation member 161) is 1.0 mm, and, to be exact, the outer end of the current receiver member 11*a* (11*b*) is spaced by the distance L1 of 1.0 mm from the outer end of the electrical insulation member 161 remote from the current receiver member 11*a* (11*b*) (i.e., near the heating roller mount unit 17). The height L2 of the electrical insulation member 161 from the outer surface of the core roller 10 (i.e., thickness of the member 161) is 2.0 mm. A relationship of L3≧L1 is satisfied. The electrical insulating members 161 are made of polyimide, and entirely cover the outer side surfaces of the current receiver members 11*a* and 11*b*, respectively.

A pair of electrically conductive current supply members 12*a* and 12*b* made of carbon are arranged in contact with the outer peripheral surfaces of the current receiver members 11*a* and 11*b*, respectively. The current supply members 12*a* and 12*b* are pressed against the current receiver members 11*a* and 11*b* respectively by pressing means (e.g., spring) (not shown), so that electrical connection at the contact surfaces between them is kept even when the current receiver members 11*a* and 11*b* rotate together with the core roller 10. The current supply member 12*a* is connected to one of terminals of a power supply (not shown), and the current supply member 12*b* is connected to the other end of the power supply, so that the power supply applies a voltage to the resistance heating material layer 13.

In the fixing device according to the invention described above, the power supply (not shown) applies a voltage to the resistance heating material layer 13 via the current supply members 12*a* and 12*b* and the current receiver members 11*a* and 11*b*, so that the resistance heating material layer 13 itself generates Joule-heat to raise the temperature of the heating roller 1A. The heating roller 1A is kept at a predetermined fixing temperature by temperature sensing means (not shown) for sensing the temperature of the heating roller 1A and control means (not shown) for controlling the applied voltage from the power supply based on the temperature sensed by the temperature sensing means. The record member bearing an unfixed toner image is transferred between the heating roller 1A at the fixing temperature and the pressure roller 2, during which the toner image is fixed to the record member by heat and pressure.

According to the fixing device of the invention shown in FIG. 1, the heating roller 1A is insulated owing to provision of the electrical insulation layer 151 providing appropriate insulation between the resistance heating material layer 13 and the core roller 10, and the electrically insulating coating layer 141 coating and insulating the resistance heating material layer 13. The electrical insulation members 161 cover outer sides of the current receiver members 11*a* and 11*b* and the core roller 10, and the sum of its length L1 and thickness L2 is 3 mm which is larger than 2.5 mm. Therefore, a sufficiently large distance along the surface of the electrical insulation member 161 for insulation is ensured between the current receiver member 11*a* (11*b*) and the core roller 10, and an appropriate insulation can be ensured.

Figure 2:
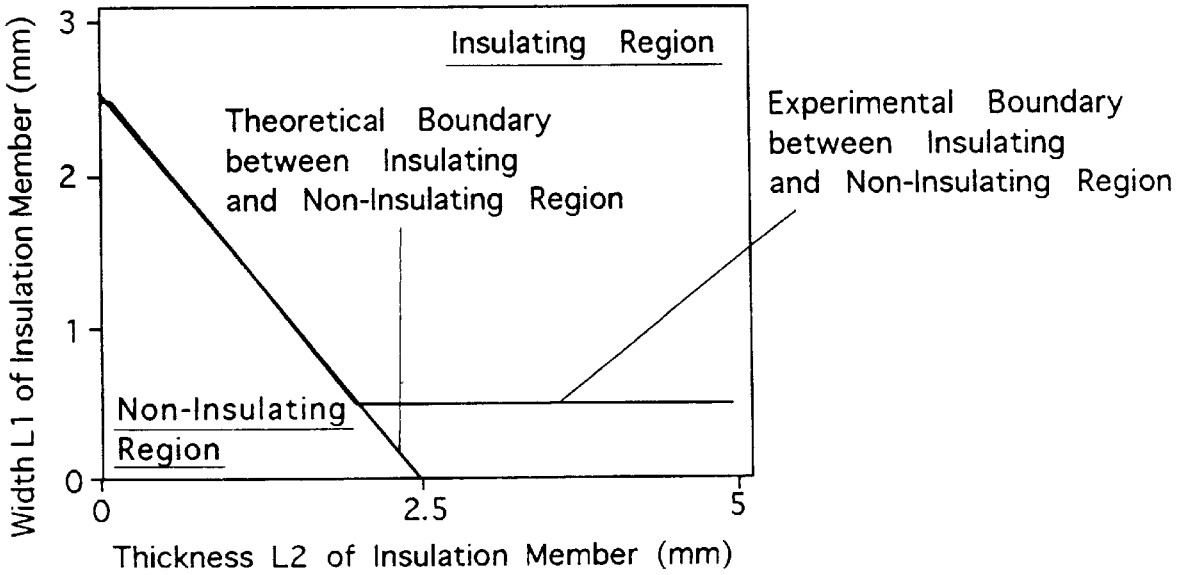
FIG. 2 shows boundaries between an insulating region and a non-insulating region with various values of a length (width) of an electrical insulating member and a thickness (height) thereof from a core roller.

A relationship between the distance L1 and the thickness L2 was studied by an experiment, from which it has been found that a relationship of L1+L2≧2.5 mm ensures the insulating properties. This experiment was performed with a fixing device of the type shown in FIG. 1 and a voltage of 230 V applied to the resistance heating material layer. The results are shown in Table 1 and FIG. 2. FIG. 2 is a graph showing a boundary between an insulating region and a non-insulating region obtained from the experiment data shown in Table 1, and also showing a theoretically safe boundary between the insulating region and the non-insulating region obtained from the experiment. In Table 1, "OK" represents that no current leak occurred, and "NG" represents that current leak occurred.

TABLE 1

| L2 (mm) | L1 (mm) | L1 + L2 (mm) | Leak |
|---|---|---|---|
| 0.05 | 1.5 | 1.55 | NG |
| 0.05 | 2.0 | 2.05 | NG |
| 0.05 | 2.5 | 2.55 | OK |
| 0.1 | 1.5 | 1.6 | NG |
| 0.1 | 2.0 | 2.1 | NG |
| 0.1 | 2.5 | 2.6 | OK |
| 0.5 | 1.5 | 2.0 | NG |
| 0.5 | 2.0 | 2.5 | OK |
| 0.5 | 2.5 | 3.0 | OK |
| 1.0 | 1.0 | 2.0 | NG |
| 1.0 | 1.5 | 2.5 | OK |
| 1.0 | 2.0 | 3.0 | OK |
| 2.0 | 0.5 | 2.5 | OK |
| 2.0 | 1.0 | 3.0 | OK |
| 2.0 | 1.5 | 3.5 | OK |
| 5.0 | 0 | 5.5 | OK |
| 5.0 | 1.0 | 6.0 | OK |
| 5.0 | 1.5 | 6.5 | OK |

From the graph showing the theoretical boundary between the insulating region and the non-insulating region shown in FIG. 2, it can be understood that the insulating properties are ensured when the relationship of L1+L2≧2.5 mm is satisfied.

In the fixing device shown in FIG. 1 according to the invention, the heating roller 1A is arranged in the fixing device in such a state that the current receiver member 11*a* (11*b*) of the heating roller 1A and the heating roller mount unit 17 are spaced by the distance L3 of 2.5 mm which is larger than 1 mm, so that a sufficient space distance can be ensured between the current receiver member 11*a* (11*b*) and the heating roller mount unit 17. This also ensures appropriate insulation.

It was discovered by an experiment that the insulating properties were ensured if the distance L3 between the current receiver member and the heating roller mount unit neighboring thereto satisfied the relationship of L3≧1 mm. This experiment was performed with the fixing device of the type shown in FIG. 1 under a high humidity environment and specifically such conditions that a humidity was 85% RH, a temperature was 30° C. and a voltage of 230 V was applied to the resistance heating material layer. The results are shown in Table 2. In Table 2, "OK" represents that no current leak occurred, and "NG" represents that current leak occurred.

TABLE 2

| Operation State | Distance L3 (mm) when Heating Roller stops | | |
|---|---|---|---|
| of Heating Roller | 0.5 | 1.0 | 1.5 |
| Rotation | NG | OK | OK |
| Stop | OK | OK | OK |

From Table 2, it can be understood that if the distance L3 is 1 mm or more, the insulating properties are ensured during rotation of the heating roller. From the column of the distance L3=0.5 mm, the following can be understood. Although the insulating properties are ensured during stop of the heating roller, current leak occurs during rotation of the heating roller, so that the difference between the insulating distance required during rotation of the heating roller and that required during stop is 0.5 mm.

In view of a safety factor, the distance L3 is desirably 2.1 mm or more if the actual safety factor for design is 10 as can be seen from Table 3.

Therefore, the required distance L3 between the current receiver member and the heating roller mount unit neighboring thereto is at least 1 mm, and preferably 2.0 to 2.1 mm or more.

In Table 3, the state of distance L3=0.5 mm (ensuring insulating properties) during stop of the heating roller is deemed as the state that the safety factor is 1. In Table 3, the required space distance is calculated from the following formula:

$$\text{Required space distance} = 0.5\sqrt{(\text{safety factor})}$$

The required space distance determined taking rotation of the heating roller into consideration is equal to the sum of the required space distance calculated with the above formula and the difference of 0.5 mm between the insulating distances during rotation and stop of the heating roller.

TABLE 3

| | Safety Factor | | | |
|---|---|---|---|---|
| | 1 | 3 | 5 | 10 |
| Required space distance | 0.5 | 0.9 | 1.1 | 1.6 |
| Required space distance in view of rotation | 1.0 | 1.4 | 1.6 | 2.1 |

In the fixing device shown in FIG. 1 according to the invention, the heating roller mount units 17 are grounded, and all the measures described above are employed. Therefore, a path of a leak current from the heating roller 1A is substantially completely interrupted, which sufficiently reduces a possibility of electric shock of an operator operating the image forming apparatus provided with the fixing device. Since the current leak from the fixing device can be sufficiently prevented, it is possible to avoid malfunction and damage of a control unit or the like in the image forming apparatus, which may be caused by the current leak from the fixing device.

Figure 3:
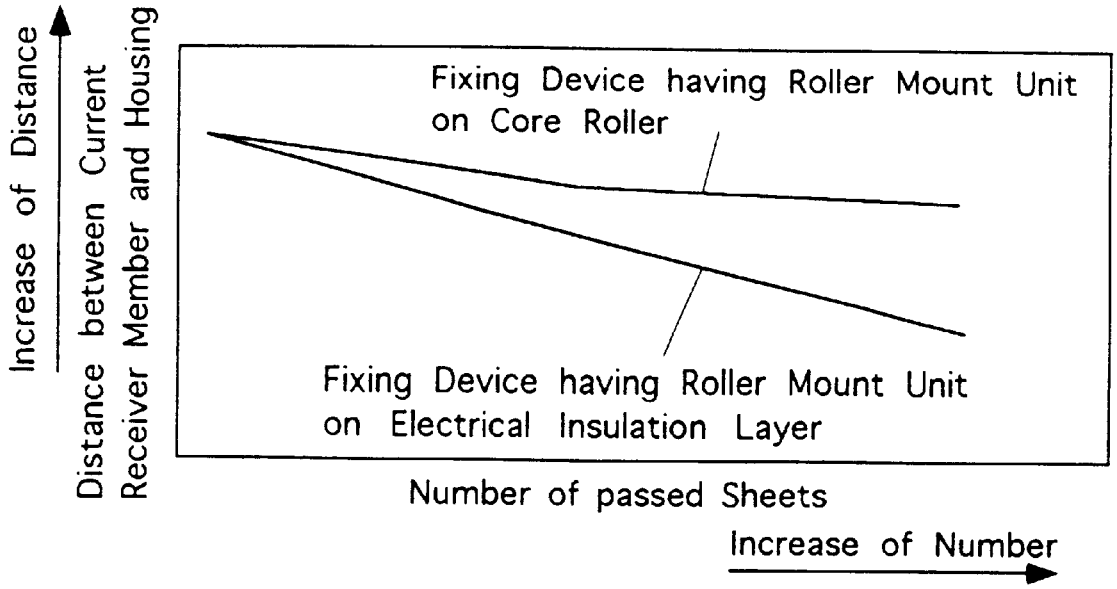
FIG. 3 shows a relationship between the number of sheets passed through a fixing device and a distance between a current receiver member and a fixing device housing in the fixing device, in which a roller mount unit of the housing is fitted to the core roller itself, and also shows a relationship between the number of sheets and the above distance in a fixing device, in which a roller mount unit of the housing is fitted to an electrical insulation layer.
Figure 9:
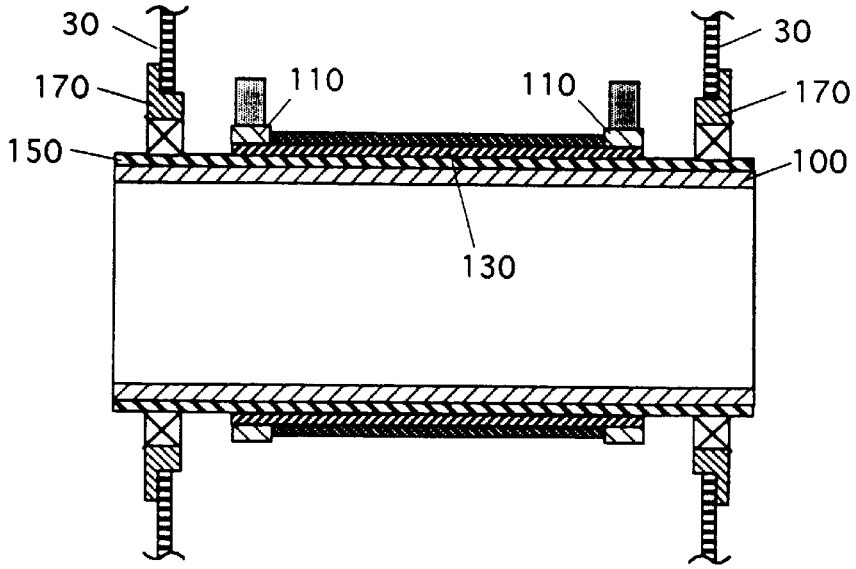
Fig.9 (Prior Art)
FIG. 9 is a schematic cross section showing a conventional example of a fixing device provided with an electrical insulation layer formed over an entire surface of a core roller.

In the fixing device shown in FIG. 1 according to the invention, the electrical insulation member 161 is arranged at the region inside the bearing mount end 101 of the core roller, and the outer peripheral surface of the core roller 10 itself is rotatably carried by the heating roller mount unit 17. Therefore, stable rotation of the heating roller 1A can be ensured as shown in FIG. 3 compared with the conventional fixing device shown in FIG. 9, in which the electrical insulation layer 150 formed entirely over the outer peripheral surface of the core roller 100 is rotatably carried by the heating roller mount unit 170. FIG. 3 shows a relationship between the number of processed sheets and the distance between the current receiver member and the fixing device housing in the fixing device of the invention, in which the core roller itself is carried by the roller mount unit, and also shows a relationship between the number of processed sheets and the distance between the current receiver member and the fixing device housing in the conventional fixing device (e.g., shown in FIG. 9), in which the electrical insulation layer of the core roller is carried by the roller mount unit.

From FIG. 3, it can be seen that the structure in which the roller mount unit directly carries the core roller itself causes less change in the above distance, and therefore can maintain the distance L3 for a long time. Therefore, the fixing device of the invention can reliably maintain the insulated state for a long time. When the record sheet is passed between the heating roller and the pressure roller, wrinkles may be formed due to vibration or shift of the heating roller. In the conventional fixing device shown in FIG. 9, the wrinkles are formed after approximately ten thousand sheets were passed. In the fixing device according to the invention, hundred thousand sheets can be processed without any wrinkle, and stable rotation of the heating roller 1A is ensured.

The length L1 of the electrical insulation member 161 in the direction of rotation axis of the heating roller 1A, the thickness L2 of the electrical insulation member 161 and the distance L3 between the outer end of the current receiver member 11*a* (11*b*) and the inner end of the heating roller mount unit 17 neighboring thereto are not restricted to 1.0 mm (L1), 2.0 mm (L2) and 2.5 mm (L3) in the above example, respectively. An effect similar to the fixing device shown in FIG. 1 can be achieved by various values provided that the relationships of L1+L2≧2.5 mm, L3≧1 mm and L3≧L1 are satisfied. It is not essential that the electrical insulation members 161 cover entirely the outer side surfaces of the current receiver members 11*a* and 11*b*, as is done in the above example. A similar effect can be achieved by such a structure that the electrical insulation members 161 cover only portions of the outer side surfaces of the current receiver members 11*a* and 11*b* or extend from the lower ends of the outer side surfaces, provided that the relationships of L1+L2≧2.5 mm, L3≧1 mm and L3≧L1.

(Second Embodiment)

Figure 4:
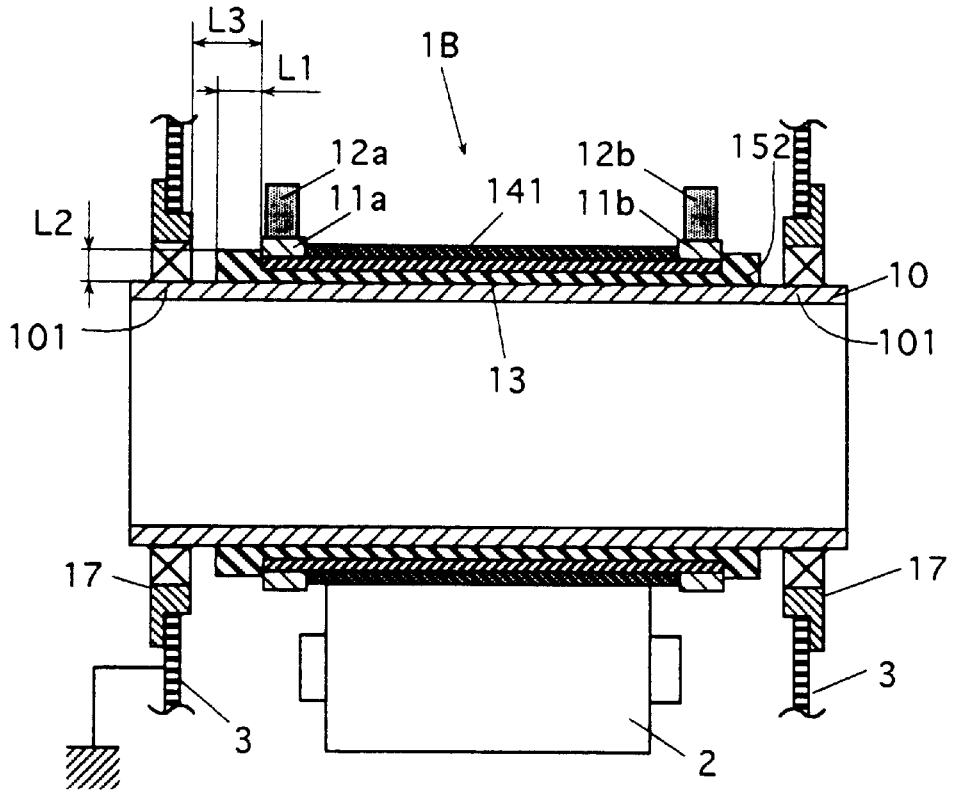
FIG. 4 is a schematic cross section showing another example of the fixing device of the first type according to the invention.

FIG. 4 is a schematic cross section showing another example of the fixing device of the first type according to the invention. In FIG. 4, parts and portions having the substantially same structures and functions as those in the fixing device shown in FIG. 1 bear the same reference numbers.

This fixing device differs from the device shown in FIG. 1 in that the electrical insulation member 161 in FIG. 1 is not employed, and an electrical insulation layer 152 formed wider than the resistance heating material layer 13 interrupts the current leak path. Description will now be given primary on points different from the fixing device shown in FIG. 1.

A heating roller 1B has a hollow and cylindrical core roller 10. The electrical insulation layer 152, the resistance heating material 13 in a layer form and the electrically insulating coating layer 141 are layered in this order on the outer peripheral surface of the core roller 10.

The core roller 10, coating layer 141, electrical insulation layer 152 and resistance heating material layer 13 are made of the same materials as those in the fixing device shown in FIG. 1.

Similarly to the fixing device shown in FIG. 1, the coating layer 141 is formed between the inner ends of the current receiver members 11*a* and 11*b* along the peripheral surface of the resistance heating material layer 13. Similarly to the fixing device shown in FIG. 1, the resistance heating material layer 13 is formed between the outer ends of the current receiver members 11*a* and 11*b* along the core roller 10.

The electrical insulation layer 152 is wider than the resistance heating material layer 13, and therefore extend to positions outside the outer ends of the current receiver members 11*a* and 11*b* and inside the bearing mount ends 101 of the core roller 10. Between the above positions, the outer peripheral surface of the core roller 10 is covered with the electrical insulation layer 152. The electrical insulation layer 152 has the end portions, which protrude beyond the outer ends of the current receiver members 11*a* and 11*b*. The length L1 of each protruded end portion in the direction of rotation axis of the heating roller 1B is 2.0 mm, and more exactly, the length L1 from the outer end of the current receiver member 11*a* (11*b*) to the outer end of the electrical insulation layer 152 remote from the current receiver member 11*a* (11*b*) (i.e., near the heating roller mount unit 17) is 2.0 mm. The protruded portion of the electrical insulation layer 152 has the height L2 of 1.0 mm from the outer surface of the core roller 10. In this example, the outer side surfaces of the current receiver members 11*a* and 11*b* are partially covered with the electrical insulation layer 152.

In the fixing device shown in FIG. 4, the electrical insulation members 161 in the fixing device shown in FIG. 1 are replaced with portions of the electrical insulation layer 152.

The current receiver members 11*a* and 11*b* are arranged to space the outer ends thereof from the inner ends of the heating roller mount units 17 by the distances L3 of 2.5 mm, respectively.

Therefore, the fixing device shown in FIG. 4 can achieve an effect similar to that by the fixing device shown in FIG. 1.

In the fixing device shown in FIG. 4, the length L1 and thickness L2 of the electrical insulation layer 152 as well as the distance L3 between the outer end of the current receiver member 11*a* (11*b*) and the inner end of the heating roller mount unit 17 neighboring thereto are not restricted to 2.0 mm (L1), 1.0 mm (L2) and 2.5 mm (L3) in the above example, respectively. An effect similar to that by the fixing device shown in FIG. 4 can be achieved by various values provided that the relationships of L1+L2≧2.5 mm, L3≧1 mm and L3>L1 are satisfied.

(Third Embodiment)

Figure 5:
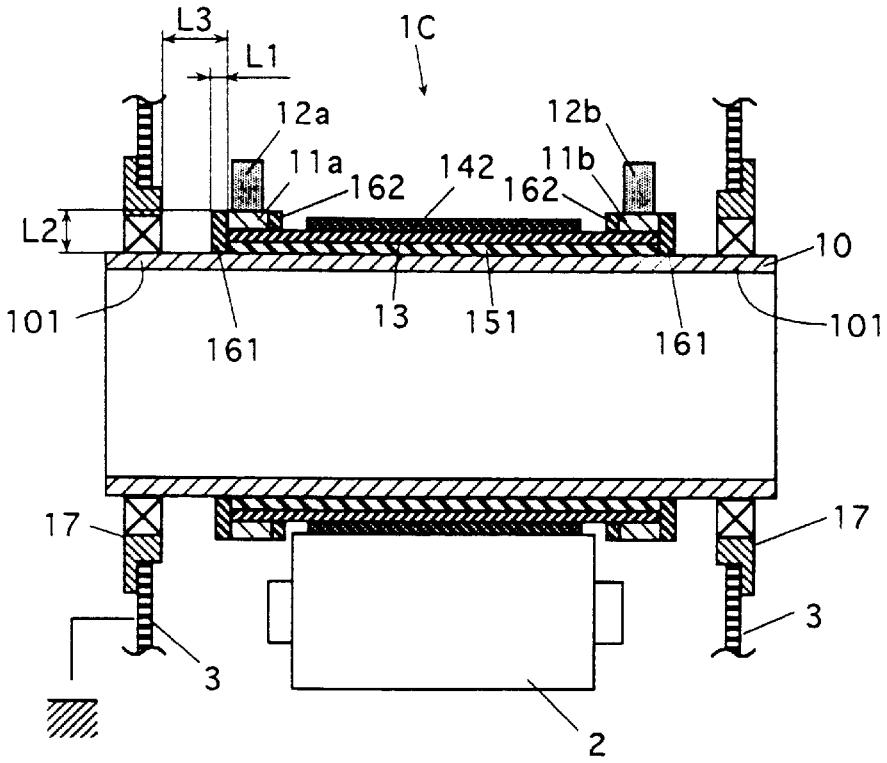
FIG. 5 is a schematic cross section showing still another example of the fixing device of the first type according to the invention.

FIG. 5 is a schematic cross section showing still another example of the fixing device of the first type according to the invention. In FIG. 5, parts and portions having the substantially same structures and functions as those in the fixing device shown in FIG. 1 bear the same reference numbers.

This fixing device differs from the fixing device shown in FIG. 1 in that the electrically insulating coating layer 142 covers only an area smaller than the entire area of the resistance heating material layer 13 between the inner ends of the current receiver members 11*a* and 11*b*, and that electrically insulation members 162 made of the same material as the electrical insulation member 161 covers portions of the outer peripheral surface of the resistance heating material layer 13 extending from the inner ends of the current receiver member 11*a* and 11*b* toward the edges of the coating layer 142, respectively. This fixing device is substantially the same as the fixing device in FIG. 1 except for the above structure.

Accordingly, this fixing device satisfies the relationships of L1+L2≧2.5 mm and L3≧1 mm, as is done in the fixing device in FIG. 1, so that insulation between the core roller 10 and the outer end surface of the current receiver member 11*a* (11*b*) is sufficiently ensured.

Insulation of the fixing device housing 3 with respect to the resistance heating material layer 13 and/or the inner side of the current receiver member 11*a* (11*b*) through a space is sufficiently ensured, because the resistance heating material layer 13 is covered with the electrical insulation member 162 which extends from the inner end of the current receiver member 11*a* (11*b*) toward a position remote from the electrical insulation member 161 and near the coating layer 142 on the surface of the resistance heating material layer 13. The electrical insulation member 162 may cover entire or partially the inner side surface of the current receiver member 11*a* (11*b*).

Therefore, this fixing device can substantially completely interrupt a path of a leak current from the heating roller 1C, and it is possible to eliminate a possibility of electric shock of an operator who operates the image forming apparatus provided with this fixing device. Since the current leak from the fixing device is prevented, it is also possible to prevent malfunction and damage of the control unit or the like in the image forming apparatus, which may be caused by current leak from the fixing device.

Since the electrical insulation member 161 is arranged inside the bearing mount end 101 of the core roller 10, stable rotation of the heating roller 1C can be ensured.

Although the first, second and third embodiments relate to the fixing device of the first type, in which the resistance heating material layer is formed on the outer peripheral surface of the core roller, the resistance heating material layer may be formed on the inner peripheral surface of the core roller.

[Fixing Device of the Second Type]

Description will now be given on the fixing device of the second type, in which the resistance heating material layer is formed on the inner peripheral surface of the core roller.

The resistance heating material layer has the inner surface coated with the coating layer made of the electrical insulation material. In the structure where the current receiver members and the heating roller carriers are arranged at opposite end portions of the heating roller, the coating layer may be formed on the entire surface between the inner ends of the current receiver members. The outer peripheral surface of the heating roller may be covered with a release layer made of a material having release properties for preventing adhesion of melted toner.

The fixing device may include a backup member which is operable to hold and pass the record member between the heating roller and the backup member for fixing the unfixed image to the record member under a pressure. The backup member may be, for example, a pressure roller pressed against the heating roller.

In the structure where the core roller of the heating roller is made of an electrically conductive material, the resistance heating material layer is preferably formed on an electrical insulation layer formed on the inner peripheral surface of the core roller. In this structure, the insulating member may be a portion of the electrical insulation layer.

Each of the insulating members may have a ring-like form formed around the inner periphery of the heating roller.

In any of the above structures, each of the insulating members may be made of at least one kind of electrical insulation materials such as resin, rubber and ceramics. These resin, rubber and ceramics may be specifically the same as those already described in connection with the fixing device of the first type.

A preferred embodiment of the fixing device of the second type will be described below as a fourth embodiment.

(Fourth Embodiment)

Figure 6:
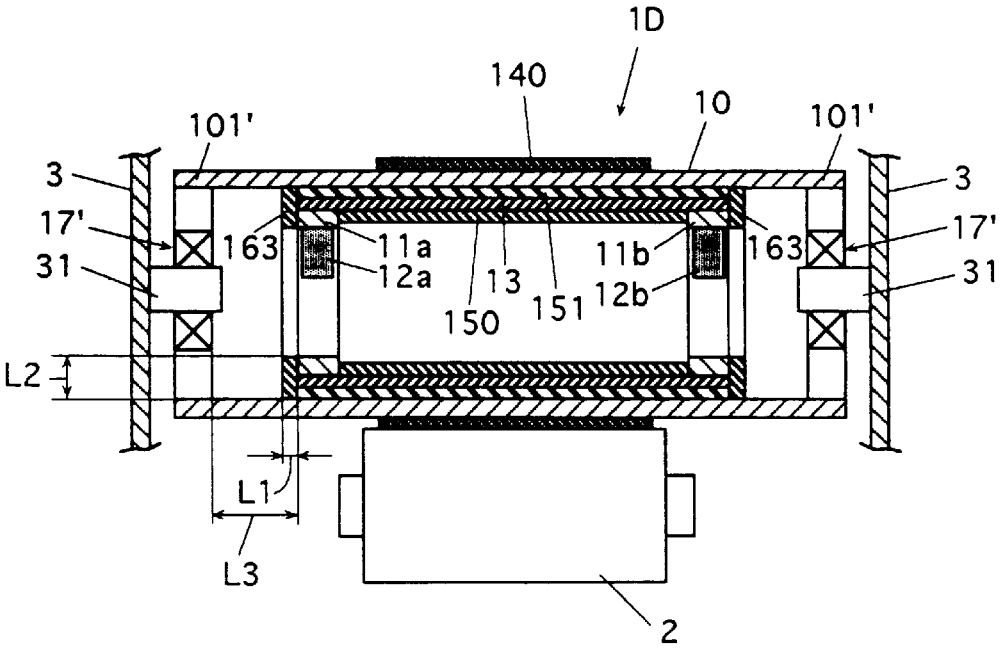
FIG. 6 is a schematic cross section showing an example of the fixing device of the second type according to the invention.

FIG. 6 is a schematic cross section showing an example of the fixing device of the second type. In FIG. 6, parts and portions having the substantially same structures and functions as those in the fixing device shown in FIG. 1 bear the same reference numbers.

A fixing roller 1D of this fixing device has a hollow and cylindrical core roller 10, of which outer peripheral surface is coated with an electrically insulating coating layer 140 having release properties. An electrical insulation layer 151, a resistance heating material layer 13 and a coating layer 150 made of electrical insulation material are layered in this order on the inner peripheral surface of the core roller 10.

The core roller 10, coating layer 140, electrical insulation layer 151 and resistance heating material layer 13 are made of the same materials as those in the fixing device shown in FIG. 1.

The electrical insulation layer 151 and the resistance heating material layer 13 formed on the inner peripheral surface of the core roller 10 have widths determined similarly to those in the fixing device shown in FIG. 1. More specifically, a pair of ring-shaped current receiver members 11*a* and 11*b* are fitted into the opposite ends of the resistance heating material layer 13. The resistance heating material layer 13 is formed between the outer ends of the current receiver members 11*a* and 11*b* and along the inner periphery of the core roller 10. The current receiver members 11*a* and 11*b* are in contact with the current supply members 12*a* and 12*b*, respectively. The electrical insulation layer 151 has the same width as the resistance heating material layer 13. The coating layer 150 is formed over the entire area between the inner ends of both the current receiver members 11*a* and 11*b*.

The inner peripheral surface of the core roller 10 is covered with electrical insulation members 163, which cover areas extending from the outer ends of the current receiver members 11*a* and 11*b* toward heating roller mount units 17' neighboring thereto but are located axially inside bearing mount ends 101 of the core roller 10, respectively.

The electrically insulating member 163 has a width L1 and a thickness L2, which satisfy the relationship of $L1+L2 \geqq 2.5$ mm. The current receiver members 11*a* and 11*b* are arranged at such positions that a distance L3 from the outer end of the current receiver member 11*a* (11*b*) to the inner end of the heating roller mount unit 17' neighboring thereto satisfies the relationship of $L3 \leqq 1$ mm. The distance L3 and the width L1 satisfies the relationship of $L3 \geqq L1$. Therefore, this fixing device can achieve an effect similar to that of the fixing device shown in FIG. 1

[Fixing Device of the Third Type]

The fixing device of the third type will be described below more in detail.

The fixing device of the third type can operate such that the heating roller is heated to a predetermined fixing temperature by flowing an electric current through the resistance heating material layer of the heating roller, and thereby can be used for heating and fixing the unfixed image to the record member. The temperature of the heating roller can be controlled based on temperature information sent from the temperature sensing element.

The temperature sensing element may be typically a thermistor.

The heat-resistant electrical insulation layer of the heating roller and the heat-resistant electrical insulation layer of the temperature sensing element have the breakdown voltages of 3000 V, respectively. These values of the breakdown voltage are determined for sufficiently preventing current leak from the resistance heating material layer to the temperature sensing element by one of the electrical insulation layers, even when insulating properties of the other electrical insulation layer are impaired or damaged. The value of 3000 V is determined based on a peak voltage ($\sqrt{2} \times 230$ V) of AC 230 V with a safety margin of ten times. The AC 230 V is determined in view of a commercial power supply of 230 V or less in various countries.

The heat-resistant electrical insulation layer of each of the heating roller and the temperature sensing element is preferably 0.4 mm or less in thickness. The heat-resistant electrical insulation layers of the heating roller and the temperature sensing element may be made of the same material.

If each heat-resistant electrical insulation layer has a thickness of 0.4 mm or less, no disadvantage occurs in responsibility of the temperature sensing element with respect to the temperature of the resistance heating material layer. The reason for this is as follows.

When heat is transferred from the resistance heating material layer at a temperature of T1 (°C.) via the electrical insulation layer of d (m) in thickness to the temperature sensing element at a temperature of T2 (°C.) [T1>T2], a quantity Q ($J/m^2 \cdot hr$) of heat passing through a unit area of the electrical insulation layer can be generally expressed by the following formula (1):

$$Q=-\lambda(T1-T2)/d \quad (1)$$

This formula (1) is called Fourier's law, and "λ"(J/m·hr·°C.) is a proportionality factor depending on the material of the electrical insulation layer.

From the formula (1), it can be understood that the quantity Q of heat transferred through the electrical insulation layer is inversely proportional to the thickness d of the electrical insulation layer. Therefore, as the thickness of the electrical insulation layer increases, the quantity of heat transferred to the temperature sensing element decreases, so that delay occurs in responsibility in the case where the temperature of the resistance heating material layer is sensed based on the temperature sensed by the temperature sensing element, and thus a large temperature ripple occurs in the temperature control.

In the case where the heat-resistant electrical insulation layer is made of, e.g., polyimide, as is done in many cases, the temperature ripple during temperature control is about 3° C. when the electrical insulation layer has a thickness of 50 μm. If the temperature ripple were 50° C. or more, it would be difficult to control the temperature of the resistance heating material layer even if the prediction control was performed for temperature control. Therefore, the heat-resistant electrical insulation layer would be required to have a thickness of 50 (μm)×16=0.8 (mm) or less, i.e., about 16 (=50/3) times as large as the 50 μm or less.

The heat-resistant electrical insulation layer in each of the heating roller and the temperature sensing element is required to be 0.4 mm or less. However, in view of the abrasion resistance or the like, the thickness of 0.02 mm or more is preferable.

In the fixing device of the third type, the temperature is transferred between the resistance heating material layer and the temperature sensing element via the heat-resistant electrical insulation layer covering the surface of the resistance heating material layer and the heat-resistant electrical insulation layer covering the temperature sensing surface of the temperature sensing element. In view of the breakdown voltage, both the heat-resistant electrical insulation layers have the equal thicknesses of 0.4 mm or less, if these layers are made of the electrical insulation material having the same or similar breakdown voltage.

Even in the structure in which the electrical insulation layer is made of an electrical insulation material other than polyimide, the temperature ripple during temperature control of the resistance heating material layer can be substantially restricted to a value smaller than 50° C. regardless of the electrical insulation material, because the polyimide and the other electrical insulation material have nearly equal proportionality factor λ.

If the heating roller has a hollow and cylindrical core roller having a sufficient rigidity, the resistance heating material layer may be formed on the inner or outer peripheral surface of the core roller. In the structure where the resistance heating material layer is formed on the outer peripheral surface of the core roller, the heat-resistant electrical insulation layer may be made of a material having high release properties.

In any case, the heat-resistant insulation layer of the heating roller may be typically made of copolymer (PFA) of tetrafluoroethylene and perfluoroalkoxy ethylene having release properties, and the heat-resistant insulation layer of the temperature sensing element may be typically made of polyimide.

Preferred examples of the fixing device of the third type will be described below as fifth and sixth embodiments.

(Fifth Embodiment)

Figure 7:
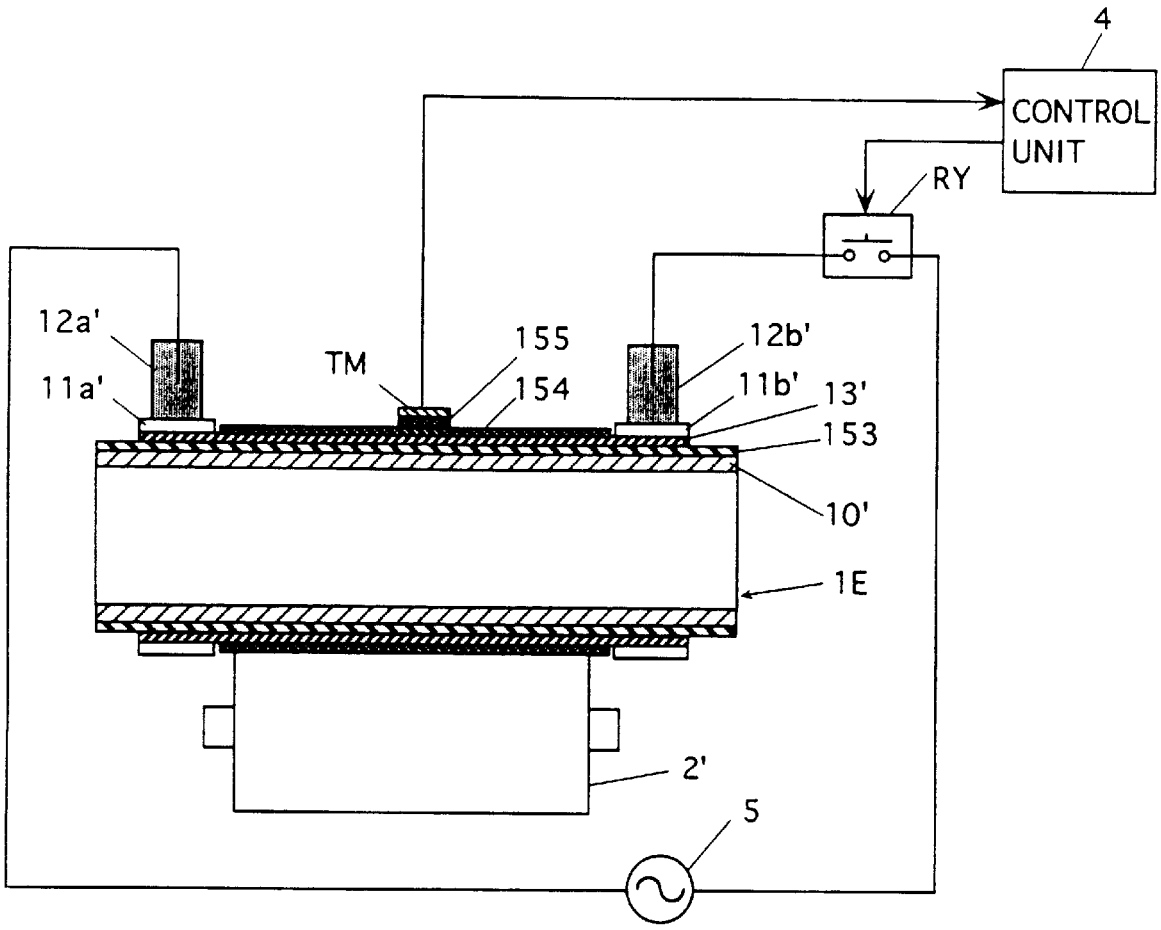
FIG. 7 is a schematic cross section showing an example of the fixing device of the third type according to the invention.

FIG. 7 is a schematic cross section showing an example of the fixing device of the third type. The fixing device is operable to heat and fix an unfixed image, i.e., toner image to the record member bearing the toner image, and can be applied to the image forming apparatus such as a printer or a copying machine.

This fixing device has a heating roller 1E and a pressure roller 2' pressed against the roller 1E by pressing means (not shown). The heating roller 1E and the pressure roller 2' are rotatably carried by carrying means (not shown), and is driven to rotate by drive means (not shown).

A heating roller 1E has a hollow and cylindrical core roller 10' made of aluminum, and an electrical insulation layer 153, a resistance heating material 13' in a layer form and a heat-resistant electrical insulation layer 154 are layered in this order on the outer peripheral surface of the core roller 10'.

The electrical insulation layer 154 is made of a heat-resistant electrically insulating resin tube (e.g., made of PFA) having a breakdown voltage of 3000 V or more with a thickness of about 0.4 mm (0.4 mm or less). This electrical insulation layer 154 has release properties for promoting release or separation of the heated toner image from the heating roller 1E when the record member is held and moved between the heating roller 1E and the pressure roller 2', and also has a width equal to or larger than the maximum width of the available record member.

The resistance heating material layer 13' has a width larger than the electrical insulation layer 154 for fitting current receiver members 11*a*' and 11*b*', which will be described later. The resistance heating material layer 13' is made of barium titanate ceramics which has a positive temperature coefficient and can generate Joule-heat when an electric current flows therethrough.

The electrical insulation layer 153 is formed between the resistance heating material layer 13' and the core roller 10' for ensuring isolation between them, and is made of polyimide which is heat-resistant insulating resin. The resistance heating material layer 13', the layers 153 and 154 and the core roller 10' rotate together.

The pair of ring-shaped current receiver members 11*a*' and 11*b*', which have an electrical conductivity and made of copper alloy, are fitted and fixed to outer peripheral portions of the opposite ends of the resistance heating material layer 13' protruded from the electrical insulation layer 154. The current receiver members 11*a*' and 11*b*' also rotate together with the core roller 10'.

A pair of electrically conductive current supply members 12*a*' and 12*b*' made of carbon are arranged in contact with the outer peripheral surfaces of the current receiver members 11*a*' and 11*b*', respectively. The current supply member 12*a*' (12*b*') is pressed against the current receiver member 11*a*' (11*b*') by pressing means (e.g., spring) (not shown), so that electrical connection between them can be ensured even when the current receiver member 11*a*' (11*b*') rotates together with the core roller 10'.

The current supply member 12*a*' is connected to one of terminals of the power supply 5. The current supply member 12*b*', is connected to the other terminal of the power supply 5 via a contact of a relay RY. By closing the contact of the relay RY, a voltage can be applied from the power supply 5 to the resistance heating material layer 13'.

The relay RY is connected to a control unit 4 for sending instruction signal relating to open/close of the contact of the relay RY. The control unit 4 also receives a temperature sensed by a thermistor TM, which is a contact temperature sensing element. The control unit 4 maintains the heating roller 1E at a fixing temperature based on the sensed temperature.

In order to sense the temperature of the heating roller 1E, the thermistor TM is in contact with the electrical insulation layer 154 via a heat-resistant electrical insulation layer 155.

The electrical insulation layer 155 is made of a heat-resistant electrically insulating resin film (e.g., polyimide film) having a breakdown voltage of 3000 V or more with a thickness of about 0.4 mm (0.4 mm or less).

In the fixing device shown in FIG. 7, a voltage is applied to the resistance heating material layer 13' of the heating roller 1E from the power supply 5 via the current supply member 12*a*' and the current receiver member 11*a*' as well as the contact of the relay RY, the current supply member 12*b*' and the current receiver member 11*b*', so that the temperature of the heating roller 1E rises. In accordance with the temperature sensed by the thermistor TM, the control unit 4 opens or closes the contact of the relay RY, and thereby controls application of the voltage to the resistance heating material layer 13' for keeping the heating roller 1E at the predetermined fixing temperature. The record member is moved between the heating roller 1E kept at the fixing temperature and the pressure roller 2', so that the toner image is fixed to the record member by heat and pressure.

In the fixing device shown in FIG. 7 according to the invention, the thermistor TM sensing the temperature of the heating roller 1E is in contact with the resistance heating material layer 13' via the electrical insulation layers 155 and 154 each having a thickness of 0.4 mm or less. Therefore, no disadvantage arises in the responsibility of the thermistor TM with respect to the temperature change of the heating roller 1E for the reasons already described. Since two layers, i.e., the electrical insulation layers 154 and 155 each having a breakdown voltage of 3000 V or more insulate the thermistor TM from the resistance heating material layer 13' supplied with a high voltage, there is no possibility of electric shock of an operator by touching a circuit or the like connected to the thermistor TM. Since there are arranged two electrical insulation layers 154 and 155 each having the breakdown voltage of 3000 V or more, the insulation can be ensure by one of the layers even when the insulating properties of the other layer are impaired due to some reasons. This also improves the reliability of insulation. As described above, the insulation is sufficiently ensured, so that a conventional safety switch can be eliminated, which enables reduction in sizes and cost of the image forming apparatus including this fixing device of the invention.

(Sixth Embodiment)

Figure 8:
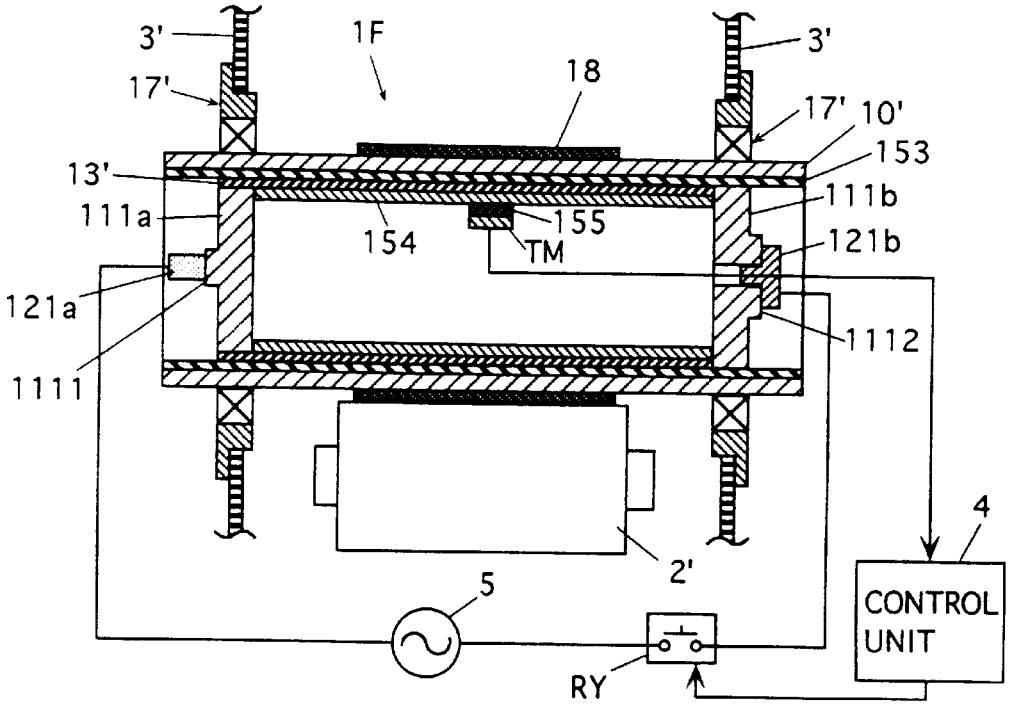
FIG. 8 is a schematic cross section showing another example of the fixing device of the third type according to the invention.

FIG. 8 is a schematic cross section showing another example of the fixing device of the third type according to the invention. In FIG. 8, parts and portions having the substantially same structures and functions as those in the fixing device shown in FIG. 7 bear the same reference numbers.

The fixing device in FIG. 8 differs from the fixing device in FIG. 7 in that the resistance heating material layer 13' is formed on the inner peripheral surface of the core roller 10'. Description will now be given primarily on this point.

A heating roller 1F has a hollow and cylindrical core roller 10', and an electrical insulation layer 153, a resistance heating material 13' in a layer form and a heat-resistant electrical insulation layer 154 are layered in this order on the inner peripheral surface of the core roller 10'. A release layer 18 having good release properties is formed at the outer peripheral surface of the core roller 10'.

A circular current receiver member 111*a* made of copper alloy and having a projection 1111 is fitted into one end portion of the resistance heating material layer 13', and a circular current receiver member 111*b* made of copper alloy and having a ring-shaped projection 1112 is fitted into the other end portion of the resistance heating material layer 13'. These current receiver members 111*a* and 111*b* are fixed to the resistance heating material layer 13', and rotate together with the core roller 10'.

A current supply member 121*a* made of carbon is in contact with the outer side of the current receiver member 111*a*, and a current supply member 121*b* made of carbon is in contact with the outer side of the current receiver member 111*b*. These current supply members 121*a* and 121*b* are pressed against the current receiver members 111*a* and 111*b* by pressing means (e.g., spring) (not shown), respectively, so that electrical contact at the contact surfaces between them is ensured when the current receiver members 111*a* and 111*b* rotate together with the core roller 10'.

A thermistor TM for sensing the temperature of the heating roller 1F is in contact with the electrical insulation layer 154 through a heat-resistant electrical insulation layer 155.

The resistance heating material layer 13' as well as electrical insulation layers 153, 154 and 155 are made of the same materials as those shown in FIG. 7.

In the fixing device in FIG. 8, control is performed similarly. More specifically, the control unit 4 opens or closes the contact of the relay RY based on the temperature information supplied from the thermistor TM, so that voltage application from the power supply 5 to the resistance heating material layer 13' is controlled to keep the heating roller 1F at the predetermined fixing temperature.

Similarly to the foregoing examples, the electrical insulation layers 154 and 155 are made of materials having a breakdown voltage of 3000 V or more with a thickness of about 0.4 mm (0.4 mm or less), so that an effect similar to that by the fixing device in FIG. 7 can be achieved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fixing device for heating and fixing an unfixed image to a record member bearing said unfixed image, comprising:

a heating roller having a layer of a resistance heating material operable to generate heat when an electric current flows therethrough, and a heat-resistant electrical insulation layer covering the surface of said resistance heating material layer; and a temperature sensing element provided for sensing a temperature of said resistance heating material layer, and having a portion being in contact with said heat-resistant electrical insulation layer of said heating roller and covered with a heat-resistant electrical insulation layer, wherein each of said heat-resistant electrical insulation layer of said heating roller and said heat-resistant electrical insulation layer of said temperature sensing element has a breakdown voltage of 3000 V or more.

2. A fixing device according to claim 1, wherein said heat-resistant electrical insulation layer of each of said heating roller and said temperature sensing element is 0.4 mm or less in thickness.

3. A fixing device according to claim 2, wherein said heat-resistant electrical insulation layer of said heating roller and said heat-resistant electrical insulation layer of said temperature sensing element are made of the same material.

4. A fixing device according to claim 2, wherein said heating roller has a cylindrical core roller having a rigidity, and said resistance heating material layer is formed on the inner peripheral surface of said core roller.

5. A fixing device according to claim 2, wherein said heating roller has a cylindrical core roller having a rigidity, and said resistance heating material layer is formed on the outer peripheral surface of said core roller.

6. A fixing device according to claim 5, wherein said heat-resistant electrical insulation layer of said heating roller is made of a material having release properties.

* * * * *